US007010417B2

(12) United States Patent
Edwards, II et al.

(10) Patent No.: US 7,010,417 B2
(45) Date of Patent: Mar. 7, 2006

(54) SYSTEM AND METHOD FOR DETERMINING MAXIMUM AVAILABLE ENGINE TORQUE

(75) Inventors: Ward R. Edwards, II, Columbus, IN (US); David A. Bolis, Nashville, IN (US); Alan R. Ford, Columbus, IN (US); William A. Monette, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 250 days.

(21) Appl. No.: 10/308,729

(22) Filed: Dec. 3, 2002

(65) Prior Publication Data

US 2004/0107040 A1 Jun. 3, 2004

(51) Int. Cl.
*G06G 7/70* (2006.01)

(52) U.S. Cl. ..... 701/110; 701/102; 701/104; 701/114

(58) Field of Classification Search ..... 701/51, 701/84, 97, 98, 102, 104, 110, 114
See application file for complete search history.

(56) References Cited

U.S. PATENT DOCUMENTS

| | | | | |
|---|---|---|---|---|
| 4,619,234 A | | 10/1986 | Okamoto | 123/357 |
| 4,643,154 A | | 2/1987 | Matsuno et al. | 123/501 |
| 4,727,836 A | | 3/1988 | Oshizawa et al. | 123/357 |
| 4,803,966 A | | 2/1989 | Denz | 123/478 |
| 4,884,546 A | | 12/1989 | Sogawa | 123/486 |
| 4,987,544 A | | 1/1991 | Honda et al. | 364/431.25 |
| 5,067,461 A | | 11/1991 | Joachim et al. | 123/357 |
| 5,111,789 A | | 5/1992 | Moriya et al. | 123/357 |
| 5,174,259 A | | 12/1992 | Shinzawa | 123/357 |
| 5,190,008 A | | 3/1993 | Yamasaki et al. | 123/306 |
| 5,261,378 A | | 11/1993 | Fenchel et al. | 123/501 |
| 5,293,853 A | | 3/1994 | Berger et al. | 123/357 |
| 5,339,781 A | | 8/1994 | Osawa | 123/357 |
| 5,375,577 A | | 12/1994 | Betts, Jr. et al. | 123/430 |
| 5,377,112 A | | 12/1994 | Brown, Jr. et al. | 364/431.12 |
| 5,540,205 A | | 7/1996 | Davis et al. | 123/486 |
| 5,642,709 A | | 7/1997 | Ozaki et al. | 123/361 |
| 5,680,842 A | | 10/1997 | Schmid | 123/357 |
| 5,692,472 A | * | 12/1997 | Bederna et al. | 123/350 |
| 5,713,332 A | | 2/1998 | Adler et al. | 123/357 |
| 5,758,308 A | | 5/1998 | Maki et al. | 701/104 |
| 5,775,295 A | | 7/1998 | Aubourg et al. | 123/399 |
| 5,890,078 A | | 3/1999 | Furuta | 701/1 |
| 5,890,470 A | * | 4/1999 | Woon et al. | 123/350 |
| 5,921,883 A | * | 7/1999 | Bellinger | 477/33 |
| 5,948,037 A | * | 9/1999 | Muraki | 701/114 |
| 6,234,149 B1 | | 5/2001 | Mills et al. | 123/486 |
| 6,308,124 B1 | * | 10/2001 | Kresse et al. | 701/53 |
| 6,508,241 B1 | * | 1/2003 | Miller et al. | 123/672 |
| 6,619,258 B1 | * | 9/2003 | McKay et al. | 123/350 |
| 6,694,741 B1 | * | 2/2004 | Franklin | 60/709 |
| 6,705,301 B1 | * | 3/2004 | Dollmeyer et al. | 123/568.22 |
| 6,807,939 B1 | * | 10/2004 | Doelker et al. | 123/350 |

* cited by examiner

*Primary Examiner*—Henry C. Yuen
*Assistant Examiner*—Johnny H. Hoang
(74) *Attorney, Agent, or Firm*—Barnes & Thornburg

(57) ABSTRACT

In one embodiment, a system for determining maximum available engine output torque includes an engine speed sensor and a control computer produce a fueling command for fueling an internal combustion engine. The computer is configured to produce a maximum available engine output torque value as a function of the engine speed signal and the fueling command. In an alternate embodiment, the system includes a control computer configured to produce the maximum available engine output torque value as a function of engine speed, at least one engine intake parameter associated an intake manifold coupled to the engine, and an engine exhaust parameter associated with an exhaust gas structure coupled to the engine. In either case, an application control strategy is responsive to the maximum available engine torque value to control an engine-driven accessory as a function thereof.

34 Claims, 5 Drawing Sheets

MAXIMUM AVAILABLE FUELING

| ENGINE SPEED | F1 | F2 | F3 | • | • | • | $F_J$ |
|---|---|---|---|---|---|---|---|
| ES1 | $T_{11}$ | $T_{12}$ | $T_{13}$ | • | • | • | $T_{1J}$ |
| ES2 | $T_{21}$ | $T_{22}$ | $T_{23}$ | • | • | • | $T_{2J}$ |
| ES3 | $T_{31}$ | $T_{32}$ | $T_{33}$ | • | • | • | $T_{3J}$ |
| • | • | | | | | | • |
| • | • | | | | | | • |
| • | • | | | | | | • |
| $ES_K$ | $T_{K1}$ | • | | • | | • | $T_{KJ}$ |

70

FIG. 3

MAXIMUM AVAILABLE TORQUE=
MAXIMUM ENGINE TORQUE - ACCELERATION TORQUE (AT)

AT = f(I, DESIRED ENGINE ACCELERATION RATE)

72

FIG. 4

SYSTEM AND METHOD FOR DETERMINING MAXIMUM AVAILABLE ENGINE TORQUE

FIELD OF THE INVENTION

The present invention relates generally to systems for determining output torque capabilities of an internal combustion engine, and more specifically to systems for determining a maximum available engine output torque and/or for using such information to control engine-powered equipment for maximum productivity.

BACKGROUND OF THE INVENTION

Transient operating conditions in an internal combustion engine generally take the form of a dynamically changing engine load and/or engine speed, and to minimize cycle times and/or voltage dips it is accordingly desirable to supply maximum engine output power during such transient conditions. Engine output power is directly proportional to engine speed and engine output torque, the latter of which may be air limited during transient conditions.

With engines including a fixed-geometry turbocharger, the turbocharger's turbine swallowing capacity decreases with increasing engine speed in part due to the nozzle flow characteristic and increased pressure ratio, and also in part due to a reduction in the apparent nozzle area resulting from higher turbine rotor speed, as is known in the art. The turbocharger turbine area thus appears smaller to the incoming exhaust gases at higher engine speeds, thereby resulting in improved turbocharger response as engine speed increases. In order to maintain an optimally responsive turbocharger and thereby maximize engine output power during transient operating conditions, it is therefore important to maintain a high engine speed and minimize speed dips.

Short of developing an engine capable of producing any amount of instantaneous load that an alternator, pump or other engine-driven accessory may apply, some form of load control is typically desired to optimize system performance during transient operating conditions. Some known engine controllers provide only for the ability to ramp applied engine load at a rate designed for operation within a wide tolerance (e.g., +/−3 sigma) of engine performance. Other known engine controllers provide for engine load reduction only when engine speed has dropped below a target value. Unfortunately, neither of these engine controller types take full advantage of the transient torque capability of most engines.

What is therefore needed is a simple and accurate strategy for determining the instantaneous load capability of a supercharged or turbocharged compression ignition engine. The instantaneous engine load production parameter is preferably easily converted to a current maximum available engine output torque value that may be implemented in an engine-driven accessory control scheme, whereby system transient performance can be dynamically optimized by continuously considering the engine's maximum transient load capability.

SUMMARY OF THE INVENTION

The foregoing shortcomings of the prior art are addressed by the present invention. In accordance with one aspect of the present invention, a system for determining a current maximum available output torque of an internal combustion engine comprises means responsive to an engine output torque request for producing an engine fueling command, an engine speed sensor producing an engine speed signal indicative of a current rotational speed of the engine, and a control circuit responsive to the engine fueling command and the engine speed signal to determine a current maximum available output torque of the engine as a function thereof.

In accordance with another aspect of the present invention, a method of determining a current maximum available output torque of an internal combustion engine comprises the steps of determining an engine rotational speed of an internal combustion engine, producing an engine fueling command, based on an engine output torque request, for fueling the engine, and producing a current maximum available engine output torque value as a function of the engine rotational speed and the engine fueling command.

In accordance with a further aspect of the present invention, a system for determining a current maximum available output torque of an internal combustion engine comprises an engine speed sensor producing an engine speed signal indicative of a current rotational speed of an internal combustion engine, means for determining at least one engine intake parameter associated with operation of an intake manifold coupled to the engine, means for determining an engine exhaust parameter associated with operation of an exhaust gas flow structure coupled to the engine, and a control circuit responsive to the engine speed signal, the at least one engine intake parameter and the engine exhaust parameter operating to determine a current maximum available output torque of the engine as a function thereof.

In accordance with still another aspect of the present invention, a method of determining a current maximum available output torque of an internal combustion engine comprises the steps of determining an engine rotational speed of an internal combustion engine, determining at least one engine intake parameter associated with operation of an intake manifold coupled to the engine, determining an engine exhaust parameter associated with operation of an engine exhaust structure coupled to the engine, and producing a current maximum available engine output torque value as a function of the engine rotational speed, the at least one engine intake parameter and the engine exhaust parameter.

One object of the present invention is to provide a system and method for determining maximum available output torque produced by an internal combustion engine at any given time.

Another object of the present invention is to provide a system and method for implementing the maximum available engine output torque parameter in a control strategy for controlling an engine driven accessory.

These and other objects of the present invention will become more apparent from the following description of the preferred embodiment.

BRIEF DESCRIPTION OF THE DRAWINGS

FIG. 3 is a table populated with maximum engine output torque values each as a function of engine speed and maximum available fueling values illustrating one preferred embodiment of the maximum engine torque calculation block of FIG. 2.

FIG. 4 is a function defining maximum available engine output torque as a function of maximum engine torque and acceleration torque illustrating one preferred embodiment of the maximum available torque calculation block of FIG. 2.

DESCRIPTION OF THE PREFERRED EMBODIMENTS

Figure 1:
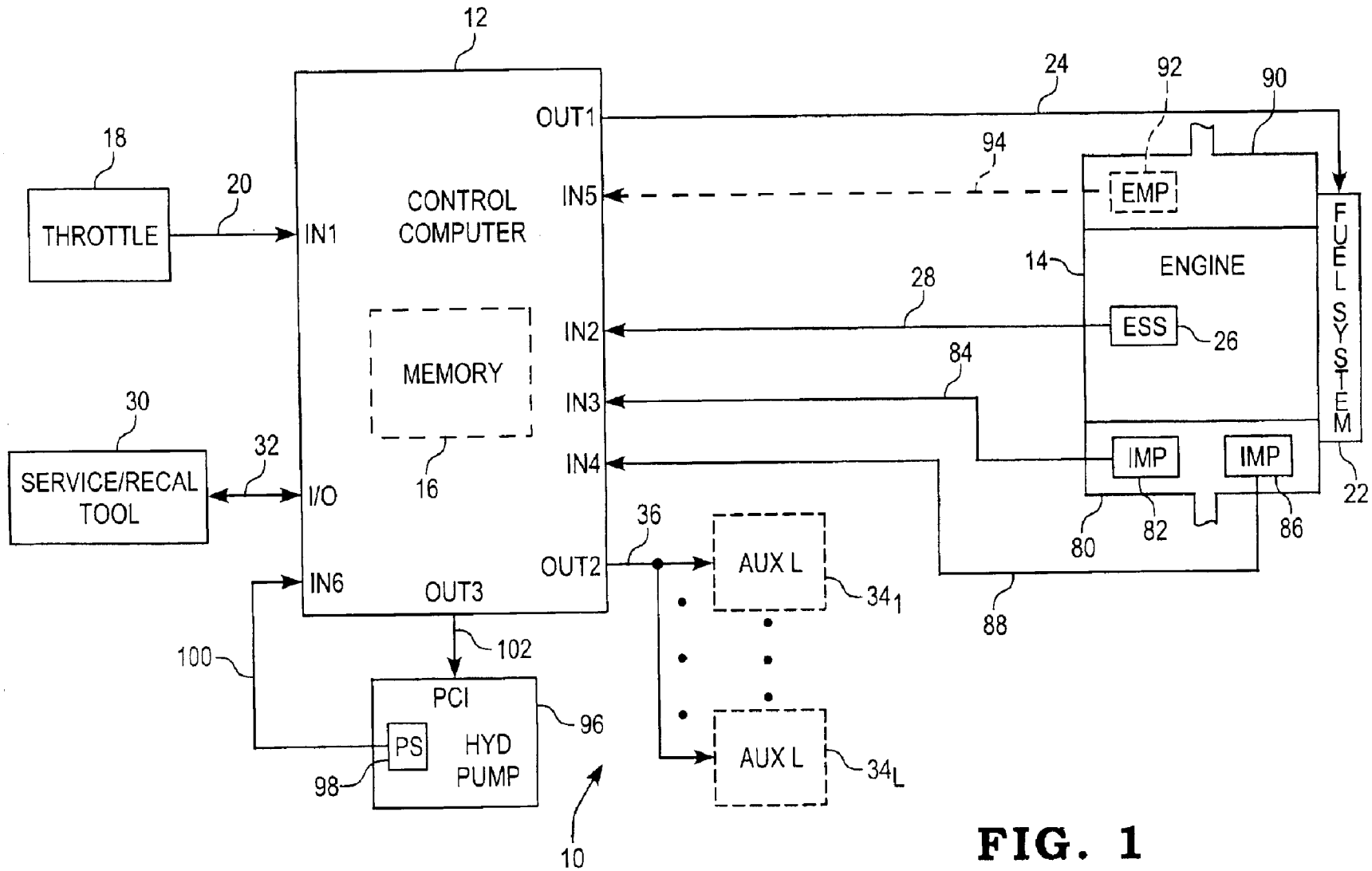
FIG. 1 is a diagrammatic illustration of one preferred embodiment of a system for determining maximum available engine output torque, and for implementing this parameter in an engine-driven accessory control strategy, in accordance with the present invention.

For the purpose of promoting an understanding of the principals of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principals of the invention as illustrated therein being contemplated as would normally occur to one skilled in the art to which the invention relates.

Referring now to FIG. 1, one preferred embodiment of a system 10 for determining maximum available engine output torque, and for implementing this variable in an engine-driven accessory control strategy, in accordance with the present invention, is shown. System 10 includes an internal combustion engine 14 having an intake manifold 80 receiving intake air and an exhaust manifold 90 expelling exhaust gasses produced by engine 14. Central to system 10 is a control computer 12 that is preferably microprocessor-based and is generally operable to control and manage the overall operation of engine 14. Control computer 12 includes a memory unit 16 as well as a number of inputs and outputs for interfacing with various sensors and systems coupled to engine 14. Control computer 12, in one embodiment, may be a known control unit sometimes referred to as an electronic or engine control module (ECM), electronic or engine control unit (ECU) or the like, or may alternatively be a general control circuit capable of operation as described hereinafter.

Control computer 12 includes a first input IN1 electrically connected to a throttle 18 via signal path 20. Throttle 18 may be any known mechanism configured to supply control computer 12 with one or more electronic signals indicative of driver-requested torque. Examples of throttle 18 include, but are not limited to, one or more foot-actuated accelerator pedals, one or more hand-actuated throttle units, a power take off (PTO) unit, a cruise control unit, or the like. Those skilled in the art will recognize other manual and/or automatic torque request mechanisms for use as throttle 18, and such other mechanisms are intended to fall within the scope of the present invention.

Control computer 12 includes a first output (OUT1) electrically connected to a fuel system 22 of engine 14 via signal path 24. Control computer 12 is operable, as is known in the art, to compute fueling commands as functions of various engine/vehicle operating conditions, and to produce one or more fueling signals corresponding thereto on signal path 24. Fuel system 22 is, in turn, responsive to the one or more fuel signals on signal path 24 to correspondingly supply fuel to engine 14.

Control computer 12 further includes a second input (IN2) electrically connected to an engine speed sensor 26 via signal path 28. Engine speed sensor 26 is operable, as is known in the art, to sense rotational speed of the engine 14 and produce an engine speed signal on signal path 28 indicative of engine rotational speed. In one embodiment, sensor 26 is a Hall effect sensor operable to determine engine speed by sensing passage thereby of a number of equi-angularly spaced teeth formed on a gear or tone wheel. Alternatively, engine speed sensor 26 may be any other known sensor operable as just described including, but not limited to, a variable reluctant sensor or the like.

Control computer 12 further includes a third input (IN3) electrically connected to an intake manifold pressure (IMP) sensor 82 via signal path 84. Preferably, sensor 82 is in fluid communication with intake manifold 80 and is a known sensor operable to produce a signal on signal path 84 indicative of intake manifold air pressure. Alternatively, control computer 12 may include one or more software algorithms operable to determine or estimate intake manifold pressure as a function of one or more engine/vehicle operating conditions, as is known in the art. Intake manifold 80 further includes an intake manifold temperature (IMT) sensor 86 in fluid communication therewith, and electrically connected to a fourth input (IN4) of control computer 12 via signal path 88. Sensor 86 may be any known temperature sensor operable to produce a temperature signal on signal path 88 indicative of intake manifold air temperature. Alternatively, control computer 12 may include one or more software algorithms operable to determine or estimate intake manifold temperature as a function of one or more engine/vehicle operating conditions.

Optionally, as shown in phantom in FIG. 1, control computer 12 includes a fifth input (IN5) electrically connected to an exhaust manifold pressure (EMP) sensor 92 via signal path 94. In this embodiment, sensor 92 is preferably a known sensor in fluid communication with exhaust manifold 90, wherein sensor 92 is operable to produce a signal on signal path 94 indicative of exhaust manifold pressure. Alternatively, control computer 12 may include one or more software algorithms operable to determine or estimate exhaust manifold pressure as a function of one or more engine/vehicle operating conditions.

Control computer 12 further includes a second output (OUT2) electrically connected to any number, L, of auxiliary systems $\mathbf{34}_1$–$\mathbf{34}_L$, wherein L may be any positive integer, via signal path 36. In this embodiment, control computer 12 is operable to determine a maximum available torque value, and produce this value on signal path 36. One or more auxiliary systems $\mathbf{34}_1$–$\mathbf{34}_L$, external to control computer 12, may then use the maximum available torque value (or alternatively a maximum engine torque value, as will be described in greater detail hereinafter) to control one or more corresponding auxiliary functions.

As an example of one preferred implementation of the present invention, control computer 12 includes a third output (OUT3) connected to a pump command input (PCI) of a hydraulic pump 96 via signal path 102. Pump 96 may be any known hydraulic pump, such as that typically used on industrial equipment, and includes a pressure sensor 98 in fluid communication therewith and electrically connected to a sixth input (IN6) of control computer 12 via signal path 100. Pressure sensor 98 may be any known pressure sensor operable to produce a pressure signal on signal path 100 indicative of hydraulic pump pressure.

Control computer 12 further includes an input/output port (I/O) electrically connectable to a service/recalibration tool 30 via communications path 32. Preferably, communications path 32 is a serial data communications path configured for serial communications in accordance with a known communications protocol (e.g., SAE J1587, SAE J1939, etc.). It is to be understood, however, that the present invention contemplates that communications path 32 may alternatively be any known communications path configured for communicating data between tool 30 and control computer 12 in accordance with a known communications protocol. In the system 10 illustrated in FIG. 1, tool 30 is preferably used to establish and/or alter at least some of the contents of memory 16 as will be described in greater detail hereinafter.

Figure 2:
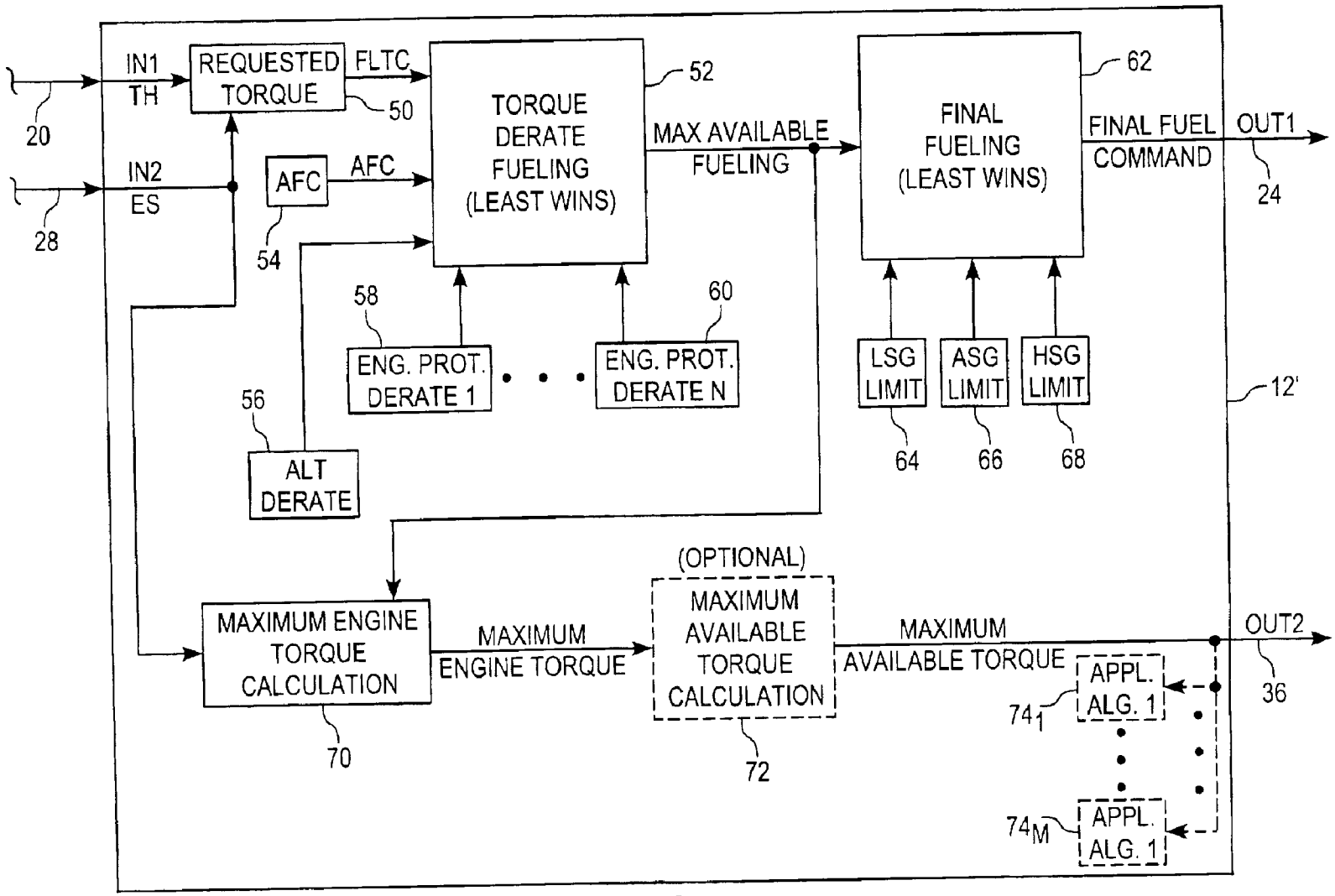
FIG. 2 is a diagrammatic illustration of one preferred embodiment of the control computer of FIG. 1 configured for determining maximum available engine output torque.

In accordance with one aspect of the present invention, system 10 of FIG. 1 is operable to determine a maximum available torque value indicative of the engine's maximum transient load capability. Referring to FIG. 2, one preferred embodiment 12' of the control computer 12 of FIG. 1, for producing the maximum available torque value in accordance with the present invention, is shown. Control computer 12' includes a requested torque block 50 receiving the throttle signal (TH) produced by throttle 18 via signal path 20. Requested torque block 50 further includes a second input receiving the engine speed signal (ES) produced by engine speed sensor 26 on signal path 28. In accordance with known techniques, requested torque block 50 is operable to process the throttle and engine speed values, TH, ES respectively, and produce a full load torque curve (FLTC) value as a function thereof. Control computer 12' further includes a torque derate fueling block 52 receiving the FLTC value from the requested torque block 50. Control computer 12' further includes an air/fuel control block 54 (AFC). AFC block 54 preferably includes a transient fuel limiting function, based on engine speed and boost pressure, configured for maintaining emissions goals under vehicle acceleration conditions and/or maximizing engine power output. In one embodiment, the AFC block preferably includes an altitude/temperate compensation strategy for correcting instantaneous fueling quantities based on changes in intake manifold air temperature and absolute ambient pressure. One preferred embodiment of such an altitude/temperature AFC algorithm is disclosed in U.S. Pat. No. 6,234,149, which is assigned to the assignee of the present invention, and the disclosure of which is incorporated herein by reference. In any case, the AFC value applied to the torque derate fueling block 52 by AFC block 54 is an engine torque derate value. Control computer 12' further includes an altitude derate block 56 producing an altitude derate value (ALT) as a function of ambient pressure. Altitude derate block 56 preferably includes a known altitude derate algorithm, such as that disclosed in U.S. Pat. No. 5,442,920 to Kamel et al., which is assigned to assignee of the present invention, and the disclosure of which is incorporated herein by reference. The altitude derate value (ALT) produced by altitude error rate block 50 is provided as another input to the torque derate fueling block 52.

Control computer 12' may further include any number, N, of engine protection derate blocks 58, 60, wherein N may be any positive integer. Any of the N engine protection derate blocks 58, 60 may include a known engine protection algorithm operable to produce an engine derate value based on one or more current engine/vehicle operating conditions, as is known in the art. Any such engine derate values produced by blocks 58, 60 are provided as inputs to the torque derate fueling block 52. Preferably, the torque derate fueling block 52 is configured according to a "least wins" control strategy such that the minimum value of the FLTC, AFC, ALT and any of the engine derate values produced by engine protection blocks 58, 60 is provided as the maximum available fueling output of torque derate fueling block 52.

The maximum available fueling value produced by the torque derate fueling block 52 is provided as an input to a final fueling block 62. A low idle speed governor (LSG) limit block 64 provides a low-idle fueling limit to final fueling block 62, and a high idle speed governor (HSG) limit block 68 provides a high-idle fueling limit to block 62. Preferably, control computer 12' further includes an engine speed governor limit block 66 supplying an engine speed fueling limit to final fueling block 62. In the embodiment shown in FIG. 2, the engine speed governor limit block 66 is illustrated as a so-called "all speed" governor (ASG) limit block, although it is to be understood that the present invention contemplates other engine speed governor embodiments producing corresponding engine speed governor limit values via block 66. In any case, the final fueling block 62 illustrated in FIG. 2 is configured in accordance with a "least wins" control strategy such that the minimum value of the maximum available fueling value produced by torque derate fueling block 52, the low-idle fueling limit produced by block 64, the high-idle fueling limit produced by block 68 and the engine speed fueling limit produced by block 66 is produced as the final fueling command at output (OUT1). The fuel system 22 (FIG. 1) is responsive to the final fuel command produced by final fueling block 62 to supply fuel to engine 14.

The foregoing functional blocks described with respect to control computer 12' of FIG. 2 are known and generally understood by those skilled in the art. In accordance with the present invention, control computer 12' further includes a maximum engine torque calculation block 70 having a first input receiving the engine speed signal (ES) produced by engine speed sensor 26 on signal path 28, and a second input receiving the maximum available fueling value produced by the torque derate fueling block 52. Block 70 is operable to process the engine speed signal and maximum available fueling value and produce a maximum engine torque value as a function thereof. Block 70 may be provided as a table, one or more mathematical equations, a graphical representation, or the like, mapping current engine speed and current maximum available fueling values to corresponding current maximum engine torque values.

Referring now to FIG. 3, one preferred embodiment of the maximum engine torque calculation block 70, in accordance with the present invention, is shown. In this embodiment, block 70 includes a tabling having rows (or columns) defined by discrete engine speed values ES1–ESK, and columns (or rows) defined by maximum available fueling values F1–FJ. The table 70 is populated by maximum engine torque values $T_{XY}$, wherein the table values are preferably determined in accordance with experimental data. In this embodiment, control computer 12' is preferably operable to determine maximum engine torque value based on current engine speed and current maximum available fueling values using linear interpolation and/or other known data estimation techniques based on the discrete maximum engine torque values populating the table 70 illustrated in FIG. 3.

Referring again to FIG. 2, control computer 12' may optionally include a maximum available torque calculation block 72 receiving as an input the maximum engine torque value produced block 70, and producing as an output a maximum available torque value that is supplied to signal path 36 via output (OUT2). As with block 70, the maximum available torque calculation block 72 may be provided as a table, one or more mathematical equations, a graphical representation, or the like, relating maximum engine torque to maximum available torque. Referring to FIG. 4, one preferred embodiment of block 72 is illustrated wherein the maximum available torque value is defined by the maximum engine torque produced by block 70 minus an acceleration torque (AT) value. In one embodiment, the acceleration torque AT is defined as a known function of engine inertia (I) and a desired engine acceleration rate. Generally, engine inertia (I) is understood to include inertial contributions of any rotating component that is rigidly connected to the engine driveline (e.g., including, but not limited to, a transmission, propeller shaft, drive axle, etc.) as well as any engine driven auxiliary components rigidly (e.g., engine-driven pumps, etc.). Preferably, the engine inertia value, I, is estimated as a function of one or more such engine/auxiliary component operating conditions in a manner known in the art. It is to be understood that any of the values of table 70 illustrated in FIG. 3 and of the equations illustrated in FIG. 4, may be established and/or modified in memory 16 via the service/recalibration tool 30 as is know in the art.

The maximum available torque value produced by block 72, or the maximum engine torque value produced by block 70, is preferably provided on signal path 36 via OUT2. Additionally, or alternatively, the maximum available torque value or the maximum engine torque value may be supplied to one or more application algorithms $\mathbf{74}_1$–$\mathbf{74}_M$ wherein M may be any integer. Any of the application algorithms $\mathbf{74}_1$–$\mathbf{74}_M$ may be used to further process the maximum available torque value (or the maximum engine torque value) for controlling an accessory or process external to control computer 12', one example of which will be described hereinafter with respect to FIG. 7.

Figure 5:
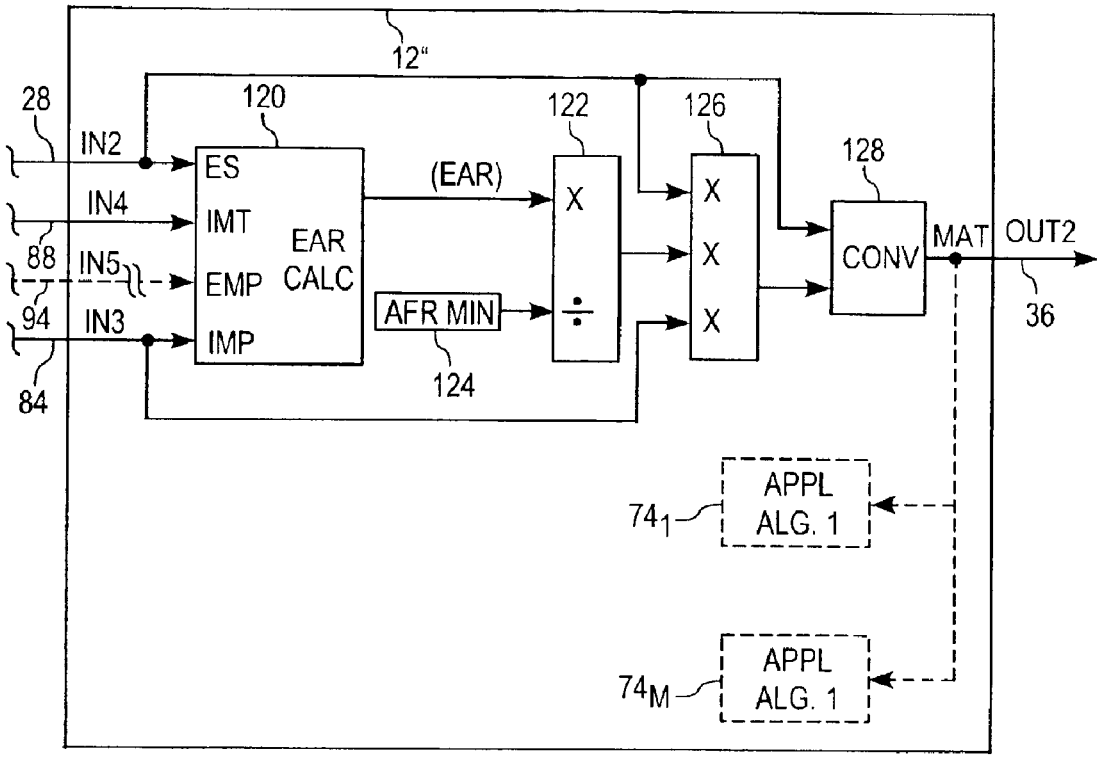
FIG. 5 is a diagrammatic illustration of an alternate embodiment of the control computer of FIG. 1 configured for determining maximum available engine output torque.

Referring now to FIG. 5, an alternate embodiment 12" of the control computer 12 illustrated in FIG. 1, in accordance with another aspect of the present invention, is shown. In this embodiment, the maximum available torque value is determined based on engine speed and current intake and exhaust manifold operating conditions. Control computer 12" includes an engine air rate (EAR) calculation block 120 having an engine speed input (ES) receiving the engine speed signal on signal path 28, an intake manifold temperature input (IMT) receiving the intake manifold temperature signal on signal path 88, an intake manifold pressure input (IMP) receiving the intake manifold pressure signal on signal path 84 and an exhaust manifold pressure input (EMP) receiving the exhaust manifold pressure signal on signal path 94. As described hereinabove, it is to be understood that any of the intake manifold temperature, intake manifold pressure and exhaust manifold pressure signals may be provided by one or more software algorithms operable to determine or estimate the corresponding manifold operating value as a function of one or more engine/vehicle operating conditions. In any case, block 120 is operable to process the forgoing signals and produce an engine air rate value (EAR) as a function thereof.

The engine air rate calculation block 120 illustrated in FIG. 5 may be provided as a table, one or more mathematical equations, graphical representation, or the like, relating the described input signals to the engine air rate value (EAR) produced thereby. In one preferred embodiment, block 120 includes an equation of the form:

$$EAR=\{[DIS/(\text{Rev/Cyc})]*V\}/(R*T) \quad (1),$$

where,

EAR is the engine air rate value,

DIS is the engine displacement, wherein DIS is generally dependent upon engine geometry, Rev/Cyc is engine revolutions per cycle, V is the volumetric efficiency of the air intake system of engine 14, R is a known gas constant (R has an approximate value of 0.2867 kJ/Kg/° K), and T is the intake manifold temperature.

In equation (1), each of the equation parameters is either known or readily ascertainable via an appropriate sensor or parameter estimation algorithm, with the exception of the volumetric efficiency value V. In one preferred embodiment of control computer 12", block 120 further includes an equation for determining or estimating the volumetric efficiency (V) of the air intake system of engine 14. Any known technique for estimating V may be used, and in one preferred embodiment of block 120, V is computed according to a known Taylor mach number-based volumetric efficiency equation given as:

$$V=A_1*(\text{Bore}/D)^2*(\text{Stroke}*ES)^B/[sqrt((*R*T)]*[(1+EMP/IMP)+A_2]\}+A_3 \quad (2),$$

where $A_1$, $A_2$, $A_3$ and B are all calibrate parameters preferably fit to the volumetric efficiency equation based on mapped engine data, BORE is the intake valve bore length, D is the intake valve diameter, Stroke is the piston stroke length, wherein BORE, D and Stroke are generally dependent upon engine geometry, γ and R are known constants, ES is engine speed, IMP is the intake manifold pressure, EMP is the exhaust manifold pressure, and T is the intake manifold temperature.

Preferably, block 120 is operable to estimate the volumetric efficiency value V in accordance with equation (2) and then substitute this value into equation (1) to determine the engine air rate value EAR.

The engine air rate value EAR is provided to a multiplication input of an arithmetic operator block 122 having a division input receiving an air/fuel ratio minimum value (AFRMIN) from block 124, wherein AFRMIN is a minimum desired air-to-fuel ratio value. The output of block 122 is provided to a first multiplication input of another arithmetic operator block 126 having a second multiplication input receiving the engine speed single (ES) on signal path 28, and a third multiplication input receiving the intake manifold pressure signal (IMP) on path 84. The output of arithmetic operator block 126 is an AFR limited fuel rate value and is provided along with the engine speed signal (ES) to a conversion block 128. Conversion block 128 is operable to process the AFR limited fuel rate value produced by block 126 and the engine speed signal, and produce the maximum available torque value on signal path 36 as a function thereof. As with control computer 12', control computer 12" may include one or more application algorithms $\mathbf{74}_1$–$\mathbf{74}_M$ receiving the maximum available torque value for controlling one or more applications or processes as a function thereof.

Figure 6:
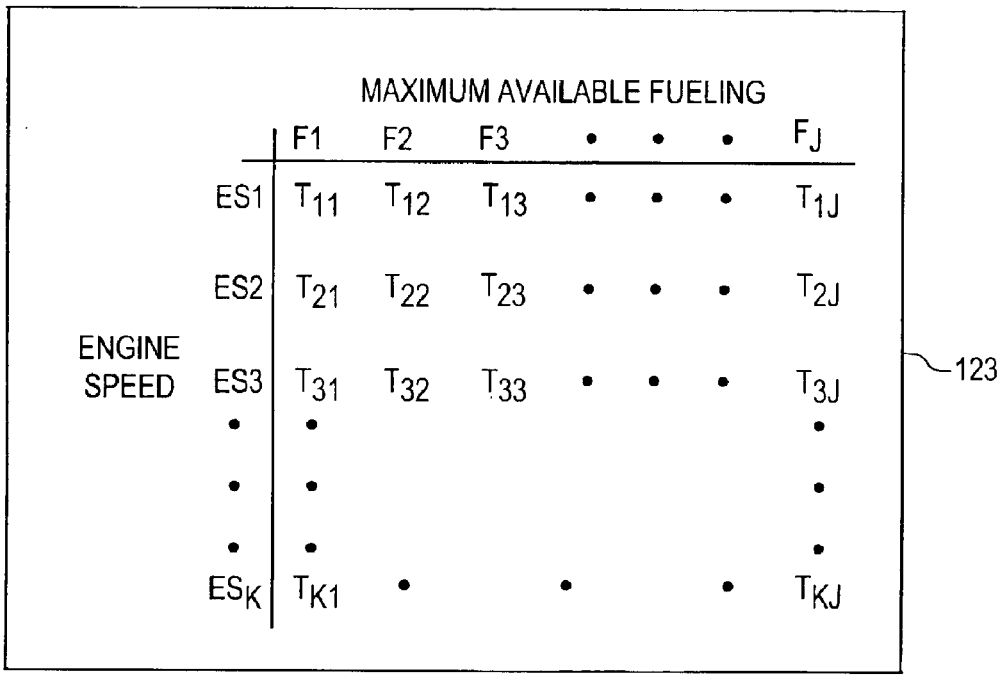
FIG. 6 is a table populated with maximum available engine output torque values each as a function of engine speed and limited fuel rate values illustrating one preferred embodiment of the conversion block of FIG. 5.

The conversion block 128 of control computer 12" may be provided as a table, one or more mathematical equations, graphical representation, or the like relating engine speed and AFR limited fuel rate values to appropriate maximum available torque values. Referring now to FIG. 6, one preferred embodiment of conversion block 128 is illustrated as a two-dimensional look-up table having rows (or columns) defining discrete engine speed values ES1–ESK, and columns (or rows) defining discrete AFR limited fuel rate values F1–FJ. The table 128 is populated by maximum available torque values $T_{XY}$, wherein control computer 12" is preferably operable to determine appropriate maximum available torque values based on current engine speed and AFR limited fuel rate values using known linear interpolation and/or other known data estimation techniques as a function of the discrete maximum available torque values populating the table 128 illustrated in FIG. 6.

Figure 7:
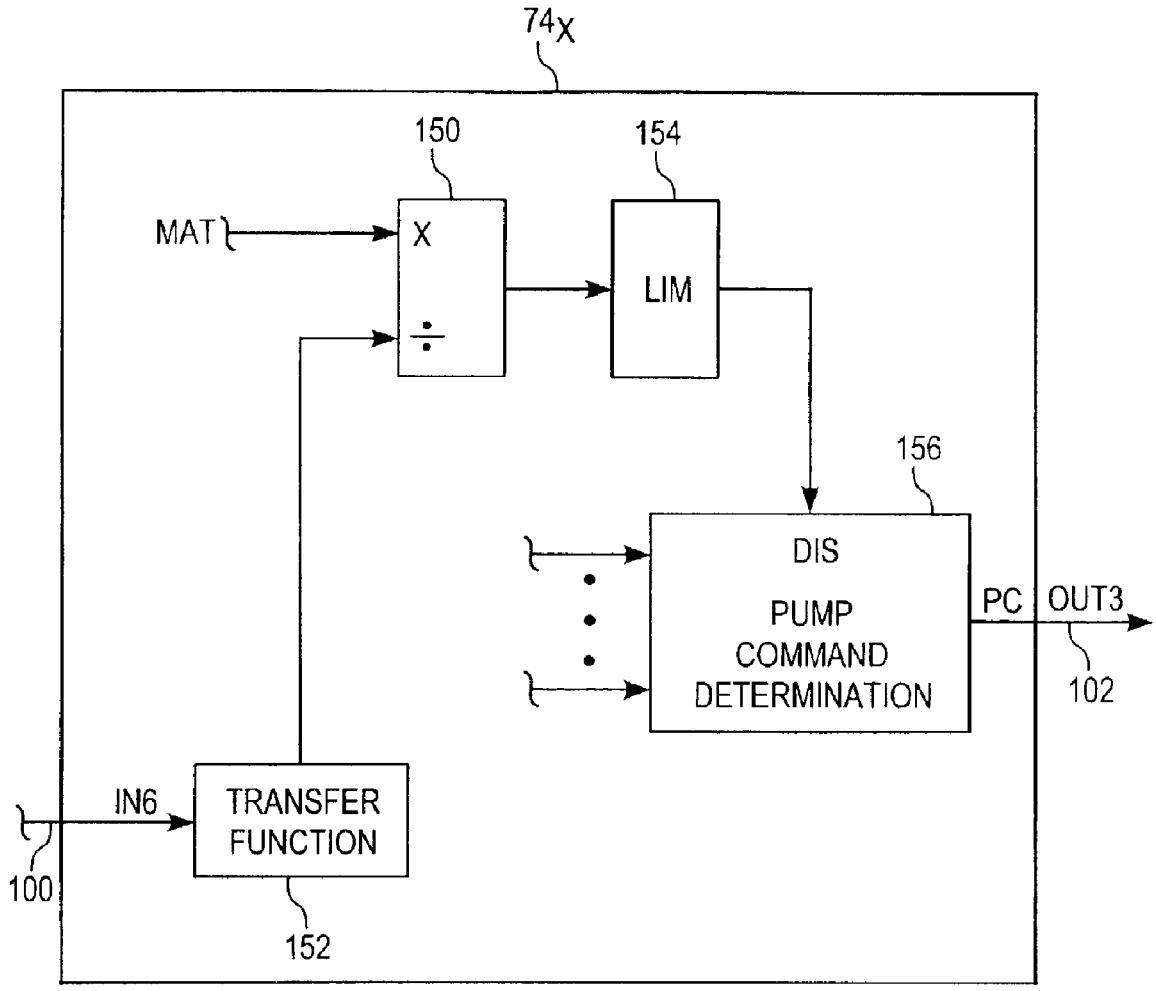
FIG. 7 is a diagrammatic illustration of one preferred embodiment of one of the application algorithm blocks of either of FIG. 2 or 5 configured for controlling an engine-driven accessory as a function of maximum available engine output torque.

Referring now to FIG. 7, an example application algorithm $\mathbf{74}_X$ is illustrated wherein the example application algorithm shown may be included in either of the control computer embodiments 12' and 12". In either case, application algorithm $\mathbf{74}_X$ is preferably operable to process the maximum available torque signal produced by ether of control computers 12' and 12", and produce a pump command (PC) for controlling hydraulic pump 96 of FIG. 1. In the example shown, application algorithm $\mathbf{74}_X$ includes an arithmetic operator block 150 having a multiplication input receiving the maximum available torque signal (MAT) and a division input receiving the output of a transfer function block 152. The transfer of function block 152 receives as an input the pressure signal produced by pressure sensor 98, which is indicative of the internal pressure of hydraulic pressure of pump 96, and multiplies this pressure value by the transfer function contained within block 152. In one embodiment, the transfer function within block 152 is preferably within the form of $(1/\tau)/(s+1/\tau)$. It is to be understood that the value of the transfer function time constant $\tau$ has an important impact on algorithm performance, wherein short time constants limit the torque and make for very smooth speed transitions, while longer time constants permit the load to exceed the available torque briefly during the transition, which results in a faster transition to the lower speed. Those skilled in the art will recognize that block 152 may include one or more additional or alternative transfer of functions, wherein any such transfer of function may be chosen to effectuate desired performance. In any case, the output of arithmetic operator block 150 divides the maximum available torque (MAT) by the filtered value of the pump pressure (the output of the transfer function block 152) to produce a maximum pump displacement that will not exceed the torque available from the engine 14. This value is provided to a limit block 154 operable to establish upper and/or lower pump displacement values wherein the output of limit block 154 is provided as a displacement input (DIS) of a pump command determination block 156. The pump command determination block 156 is operable to process the displacement command DIS provided by limit block 154, along with other known pump control parameters to produce a pump command value PC provided on signal path 102. The hydraulic pump 96 (FIG. 1) is responsive to the pump command PC produced by block 156 to activate pump 96 in a manner that will not exceed the maximum available torque produced by engine 14.

It is to be understood that the application described with respect to FIG. 7 is included only by way of example to illustrate one application of a system operable to use the maximum available torque produced by control computer 12 or 12' to control an engine driven component or accessory. It will be appreciated from the foregoing that the maximum available torque value or signal produced in accordance with the present invention may generally be provided by either control computer 12 or 12' to a machine controller, or used within computer 12 or 12', to control the operation of other engine driven components or accessories based on the maximum available torque value to thereby affect the load applied to the engine 14, and the use of the maximum available torque signal in any such system is intended to fall within the scope of the present invention.

While the invention has been illustrated and described in detail in the foregoing drawings and description, the same is to be considered as illustrative and not restrictive in character, it being understood that only preferred embodiments thereof have been shown and described and that all changes and modifications that come with the spirit of the invention are described to be protected.

What is claimed is:

1. System for determining a current maximum available output torque of an internal combustion engine, comprising:

means responsive to an engine output torque request for producing an engine fueling command is responsive to said engine output torque request to produce a current maximum available fueling command;

an engine speed sensor producing an engine speed signal indicative of a current rotational speed of said engine; and a control circuit responsive to said engine fueling command and said engine speed signal to determine a current maximum available output torque of said engine as a function of said engine speed signal and said current maximum available fueling command.

2. The system of claim 1 wherein said control circuit includes:

means responsive to said engine speed signal and said current maximum available fueling command for producing a current maximum engine output torque value as a function thereof; and means responsive to said current maximum engine output torque value for determining said current maximum available output torque of said engine as a function thereof.

3. The system of claim 2 wherein said means responsive to said engine speed signal and said current maximum available fueling command for producing a current maximum engine output torque value as a function thereof includes a table populated with discrete maximum engine output torque values each as a function of corresponding engine speed and current maximum available fueling command values.

4. The system of claim 1 further including:

means responsive to said current maximum available fueling command for producing a final fueling command; and a fuel system associated with said engine, said fuel system responsive to said final fueling command to supply fuel to said engine.

5. The system of claim 1 further including an accessory responsive to an accessory control signal to perform an accessory function;

and wherein said control circuit includes means responsive to said current maximum available output torque of said engine for producing said accessory control signal as a function thereof.

6. The system of claim 5 wherein said accessory includes an accessory sensor responsive to an operating condition of said accessory to produce sensor signal indicative of said operating condition;

and wherein said means responsive to said current maximum available output torque of said engine for producing said accessory control signal is further responsive to said sensor signal for producing said accessory control signal as a function thereof.

7. The system of claim 6 wherein said accessory is a hydraulic pump, said accessory control signal is a pump activation command, said accessory sensor is a pressure sensor and said sensor signal is a pressure signal indicative of an operating pressure of said hydraulic pump.

8. The system of claim 7 wherein said means responsive to said current maximum available output torque of said engine and said sensor signal for producing said accessory control signal includes:

means responsive to said current maximum available output torque of said engine and said pressure signal for producing a maximum pump displacement value; and means responsive to said maximum pump displacement value for producing said pump activation command.

9. A method of determining a current maximum available output torque of an internal combustion engine, comprising the steps of:

determining an engine rotational speed of an internal combustion engine;

producing an engine fueling command wherein said engine fueling command corresponds to a current maximum available fueling command, based on an engine output torque request, for fueling said engine; and producing a current maximum available engine output torque value as a function of said engine rotational speed and said engine fueling command.

Wherein the step of producing a current maximum available engine output torque value includes: producing a current maximum engine output torque value as a function of said engine rotational speed and said current maximum available fueling command; and producing said current maximum available engine output torque value as a function of said current maximum engine output torque value.

10. The method of claim 9 further including the step of producing an accessory control signal for controlling an accessory as a function of said current maximum available engine output torque value.

11. The method of claim 10 wherein the step of producing an accessory control signal further includes producing said accessory control signal as a function of an operating condition associated with said accessory.

12. The method of claim 4 wherein said accessory is a hydraulic pump, said accessory control signal is a pump activation command, and said operating condition associated with said accessory is a pump operating pressure.

13. The method of claim 12 wherein the step of producing an accessory control signal includes:

producing a current maximum pump displacement command as a function of said pump operating pressure and said current maximum available engine output torque value; and producing said pump activation command as a function of said current maximum pump displacement command.

14. System for determining a current maximum available output torque of an internal combustion engine, comprising:

an engine speed sensor producing an engine speed signal indicative of a current rotational speed of an internal combustion engine;

means for determining at least one engine intake parameter associated with operation of an intake manifold coupled to said engine;

means for determining an engine exhaust parameter associated with operation of an exhaust gas flow structure coupled to said engine; and a control circuit responsive to said engine speed signal, said at least one engine intake parameter and said engine exhaust parameter operating to determine a current maximum available output torque of said engine as a function thereof.

15. The system of claim 14 wherein said means for determining at least one engine intake parameter includes an intake manifold temperature sensor in fluid communications with said intake manifold and producing a temperature signal indicative of intake manifold temperature, said control computer determining said current maximum available output torque of said engine as a function of said temperature signal.

16. The system of claim 15 wherein said means for determining at least one engine intake parameter further includes an intake manifold pressure sensor in fluid communications with said intake manifold and producing a first pressure signal indicative of intake manifold pressure, said control computer determining said current maximum available output torque of said engine as a function of said first pressure signal.

17. The system of claim 16 wherein said means for determining an engine exhaust parameter includes means for producing a second pressure signal indicative of engine exhaust pressure, said control computer determining said current maximum available output torque of said engine as a function of said second pressure signal.

18. The system of claim 17 wherein said control computer includes:

means responsive to said temperature signal, said engine speed signal and said first and second pressure signals for determining a current engine fuel rate limit; and means responsive to said engine speed signal and said current engine fuel rate limit for producing said current maximum available engine output torque value.

19. The system of claim 18 wherein said means responsive to said engine speed signal and said current engine fuel rate limit for producing said current maximum available engine output torque value includes a table populated with discrete maximum engine output torque values each as a function of corresponding engine speed and current engine fuel rate limit values.

20. The system of claim 14 wherein said control computer includes:

means responsive to said engine speed signal, said at least one engine intake parameter and said engine exhaust parameter for determining a current engine fuel rate limit; and means responsive to said engine speed signal and said current engine fuel rate limit for producing said current maximum available engine output torque value.

21. The system of claim 14 further including an accessory responsive to an accessory control signal to perform an accessory function;

and wherein said control circuit includes means responsive to said current maximum available output torque of said engine for producing said accessory control signal as a function thereof.

22. The system of claim 21 wherein said accessory includes an accessory sensor responsive to an operating condition of said accessory to produce sensor signal indicative of said operating condition;

and wherein said means responsive to said current maximum available output torque of said engine for producing said accessory control signal is further responsive to said sensor signal for producing said accessory control signal as a function thereof.

23. The system of claim 22 wherein said accessory is a hydraulic pump, said accessory control signal is a pump activation command, said accessory sensor is a pressure sensor and said sensor signal is a pressure signal indicative of an operating pressure of said hydraulic pump.

24. The system of claim 23 wherein said means responsive to said current maximum available output torque of said engine and said sensor signal for producing said accessory control signal includes:

means responsive to said current maximum available output torque of said engine and said pressure signal for producing a maximum pump displacement value; and means responsive to said maximum pump displacement value for producing said pump activation command.

25. A method of determining a current maximum available output torque of an internal combustion engine, comprising the steps of:

determining an engine rotational speed of an internal combustion engine;

determining at least one engine intake parameter associated with operation of an intake manifold coupled to said engine;

determining an engine exhaust parameter associated with operation of an engine exhaust structure coupled to said engine; and producing a current maximum available engine output torque value as a function of said engine rotational speed, said at least one engine intake parameter and said engine exhaust parameter.

26. The method of claim 25 wherein the step of determining at least one engine intake parameter includes determining a temperature within said intake manifold.

27. The method of claim 26 wherein the step of determining at least one engine intake parameter further includes determining a pressure within said intake manifold.

28. The method of claim 27 wherein the step of determining an engine exhaust parameter includes determining a pressure of exhaust gas produced by said engine.

29. The method of claim 28 wherein the step of determining said current maximum available engine output torque value includes:

determining a current fuel rate limit as a function of said engine rotational speed, said temperature within said intake manifold, said pressure within said intake manifold and said pressure of exhaust gas produced by said engine; and producing said current maximum available engine output torque value as a function of said current fuel rate limit and said engine rotational speed.

30. The method of claim 25 wherein the step of determining said current maximum available engine output torque value includes:

determining a current fuel rate limit as a function of said engine rotational speed, said at least one engine intake parameter and said engine exhaust parameter; and producing said current maximum available engine output torque value as a function of said current fuel rate limit and said engine rotational speed.

31. The method of claim 25 further including the step of producing an accessory control signal for controlling an accessory as a function of said current maximum available engine output torque value.

32. The method of claim 31 wherein the step of producing an accessory control signal further includes producing said accessory control signal as a function of an operating condition associated with said accessory.

33. The method of claim 32 wherein said accessory is a hydraulic pump, said accessory control signal is a pump activation command, and said operating condition associated with said accessory is a pump operating pressure.

34. The method of claim 33 wherein the step of producing an accessory control signal includes:

producing a current maximum pump displacement command as a function of said pump operating pressure and said current maximum available engine output torque value; and producing said pump activation command as a function of said current maximum pump displacement command.

* * * * *

UNITED STATES PATENT AND TRADEMARK OFFICE

CERTIFICATE OF CORRECTION

PATENT NO. : 7,010,417 B2
APPLICATION NO. : 10/308729
DATED : March 7, 2006
INVENTOR(S) : Edwards, II et al.

It is certified that error appears in the above-identified patent and that said Letters Patent is hereby corrected as shown below:

In the Claims:
Claim 12
Column 11, line 47, “4” should be changed to --11--.

Signed and Sealed this

Sixth Day of March, 2007

JON W. DUDAS
*Director of the United States Patent and Trademark Office*